US005424494A

United States Patent [19]

Houle et al.

[11] Patent Number: 5,424,494

[45] Date of Patent: Jun. 13, 1995

[54] NOISE-ATTENUATING INTERNAL COMBUSTION ENGINE AIR INTAKE SYSTEM

[75] Inventors: Dennis E. Houle, Chatham; Stephen E. Brackett, Blenheim, both of Canada

[73] Assignee: Siemens Automotive Limited, Chatham, Canada

[21] Appl. No.: 988,578

[22] Filed: Dec. 10, 1992

[51] Int. Cl.[6] ..... F02M 35/00

[52] U.S. Cl. ..... 181/229; 181/246; 181/255

[58] Field of Search ..... 181/229, 246, 247, 255, 181/269, 271, 282, 226

[56] References Cited

U.S. PATENT DOCUMENTS

| | | | |
|---|---|---|---|
| 3,835,956 | 9/1974 | Kishira | 181/229 |
| 4,361,206 | 11/1982 | Tsai | 181/255 |
| 4,782,912 | 11/1988 | Wandless | 181/229 |
| 4,790,864 | 12/1988 | Kostun | 181/229 |
| 4,936,413 | 6/1990 | Lee | 181/229 X |
| 5,016,728 | 5/1991 | Zulawski | 181/229 |
| 5,162,621 | 11/1992 | Lee | 181/229 |
| 5,163,387 | 11/1992 | Lee | 181/229 |

*Primary Examiner*—M. L. Gellner
*Assistant Examiner*—Khanh Dang
*Attorney, Agent, or Firm*—Russel C. Wells

[57] ABSTRACT

Noise is attenuated by a resonator having an inlet pipe leading to an expansion chamber and an outlet pipe leading from the expansion chamber. The two pipes are not aligned with each other at the expansion chamber. The portions of the two pipes proximate the expansion chamber contain respective venturis. The expansion chamber also functions as a Helmholtz resonator by providing the resonator with one or more apertures between the outlet pipe and the expansion chamber.

10 Claims, 3 Drawing Sheets

NOISE-ATTENUATING INTERNAL COMBUSTION ENGINE AIR INTAKE SYSTEM

FIELD OF THE INVENTION

This invention relates generally to internal combustion engines, and in particular to a noise-attenuating air intake system for such an engine.

BACKGROUND AND SUMMARY OF THE INVENTION

It is known to place a resonator in an engine air intake system for attenuating engine noise. One form of resonator comprises an expansion chamber; another, one or more venturi sections; still another a Helmholtz resonator. Examples are disclosed in the following U.S. patent documents: U.S. Pat. Nos. 4,936,413; 4,790,864; 4,782,912; 5,162,621; and 5,163,387. From certain of these it is known to fabricate the resonator expansion chamber as a single, blow-molded plastic part.

The present invention relates to an engine air intake system having a novel resonator that is suited for fabrication from one or more plastic parts using blow-molding, or injection-molding and vibration welding procedures.

According to a first general aspect, the present invention relates to an internal combustion engine air intake system comprising a resonator for attenuating engine noise that propagates through the system in a direction opposite intake air flow, the resonator having a walled expansion chamber, an inlet pipe for conveying intake air to the expansion chamber and an outlet pipe for conveying air from the expansion chamber, characterized in that the inlet pipe comprises an upstream end via which air enters the resonator, a downstream end via which air passes from the inlet pipe to the expansion chamber, and a venturi section through which air passes before entering the expansion chamber, and the outlet pipe comprises an upstream end via which air passes from the expansion chamber, a downstream end via which air leaves the resonator, and a venturi section through which air passes after leaving the expansion chamber, and characterized further in that the downstream end of the inlet pipe and the upstream end of the outlet pipe are not aligned with each other at the expansion chamber.

Some of the more specific aspects of this first general aspect of the invention relate: to the inlet pipe, the expansion chamber, the outlet pipe, and the venturi sections being integrated into a unitary part made of plastic; and to the inlet pipe being also communicated to the expansion chamber by aperture means to also render the expansion chamber a Helmholtz resonator for frequencies related to a dimensional characteristic of the aperture means.

Another general aspect of the invention relates to: an internal combustion engine air intake system comprising a resonator for attenuating engine noise that propagates through the system in a direction opposite intake air flow, the resonator having a walled expansion chamber and piping comprising an inlet pipe for conveying intake air to the expansion chamber and an outlet pipe for conveying air from the expansion chamber, characterized in that the piping comprises a venturi section through which intake air passes and in that the piping is also communicated to the expansion chamber by aperture means to also render the expansion chamber a Helmholtz resonator for frequencies related to a dimensional characteristic of the aperture means.

One of the more specific aspects falling within this latter general aspect of the invention involves the resonator being a single, blow-molded plastic part, or a part formed by uniting several injection-molded parts.

Further features and characteristics of the invention, along with those already described, will be seen in the ensuing description and claims which are accompanied by drawings. These drawings disclose a presently preferred embodiment of the invention representing the best mode contemplated at this time for carrying out the invention.

DESCRIPTION OF THE PREFERRED EMBODIMENT

Figure 1:
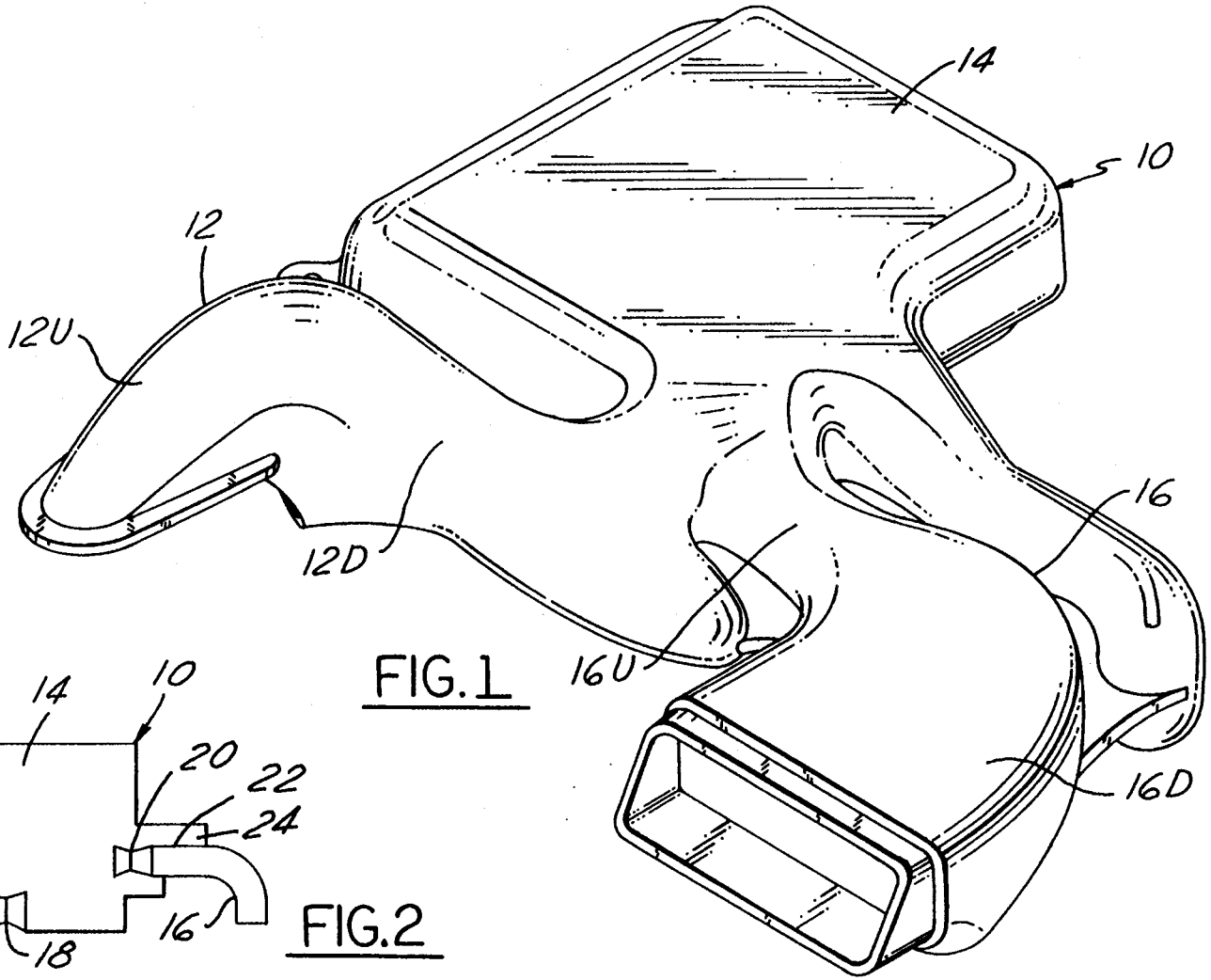
FIG. 1 is a perspective view of a resonator embodying principles of the invention.
Figure 2:
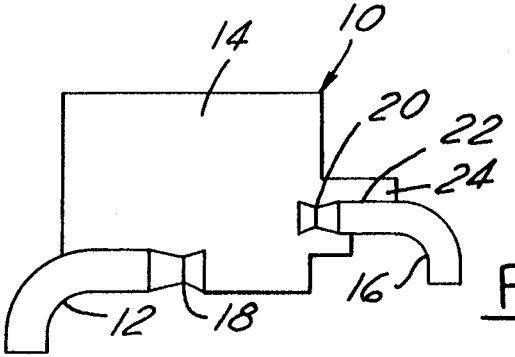
FIG. 2 is a schematic diagram of an engine air intake system which includes the resonator of FIG. 1.
Figure 3:
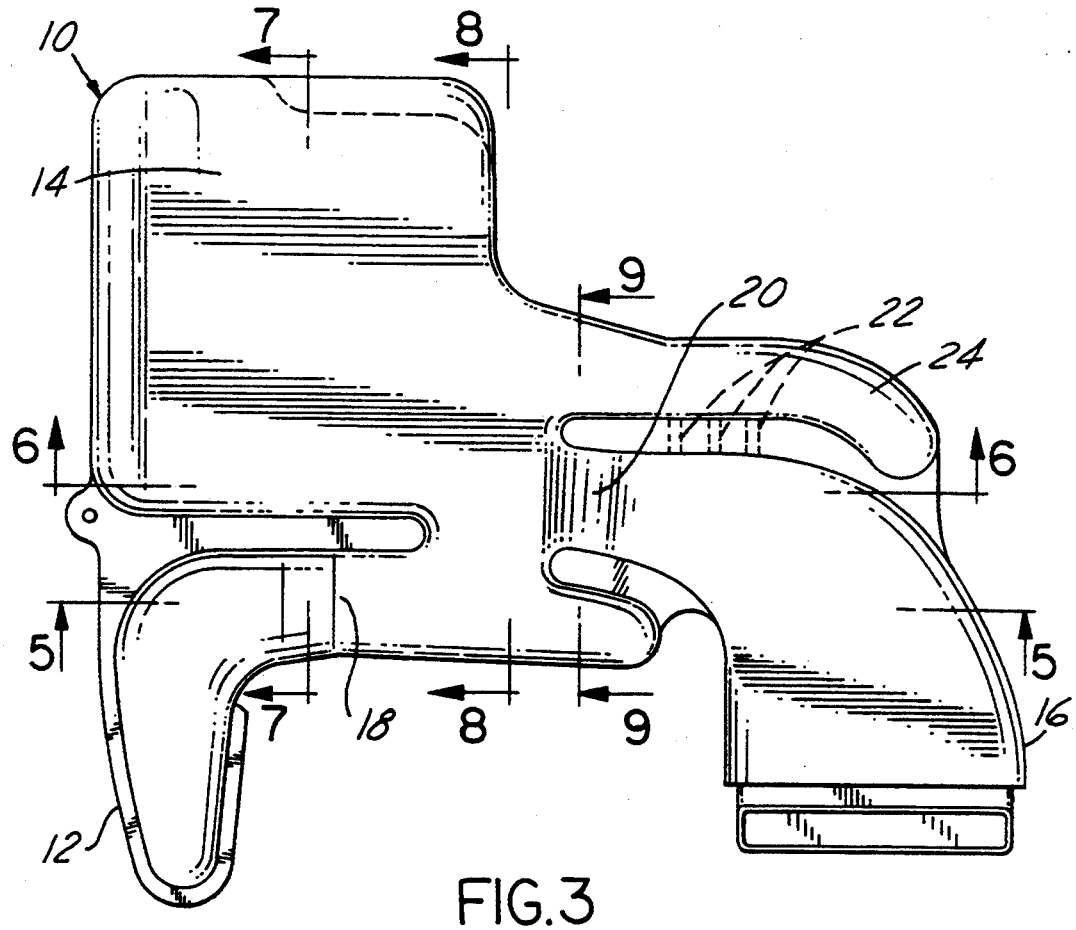
FIG. 3 is a top plan view of the resonator of FIG. 1.
Figure 4:
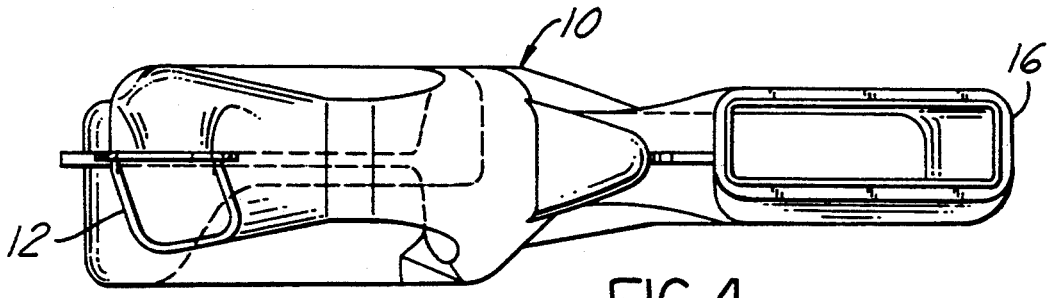
FIG. 4 is a front elevational view of FIG. 3.
Figure 5:
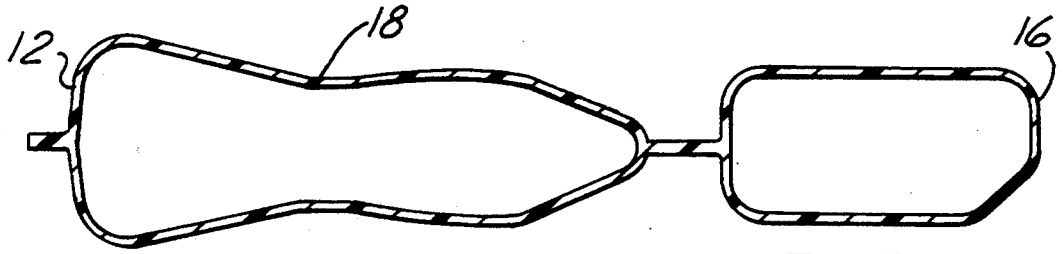
FIGS. 5, 6, 7, 8, and 9 are respective cross sectional views taken along the respective lines 5—5, 6—6, 7—7, 8—8, and 9—9 in FIG. 3.
Figure 6:
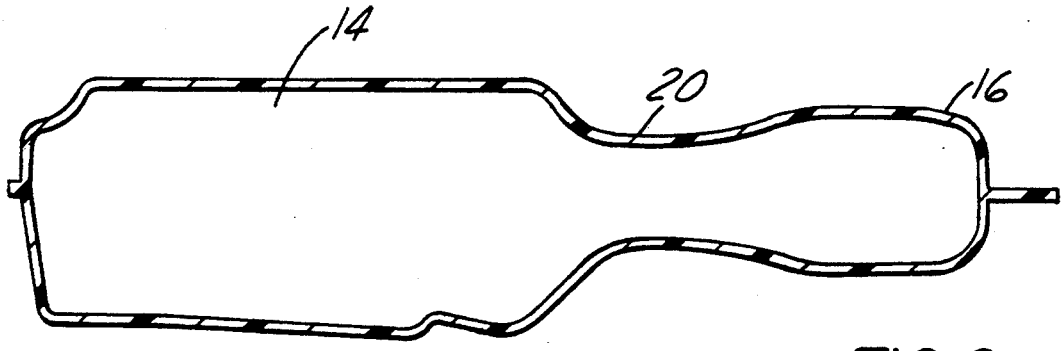
Figure 7:
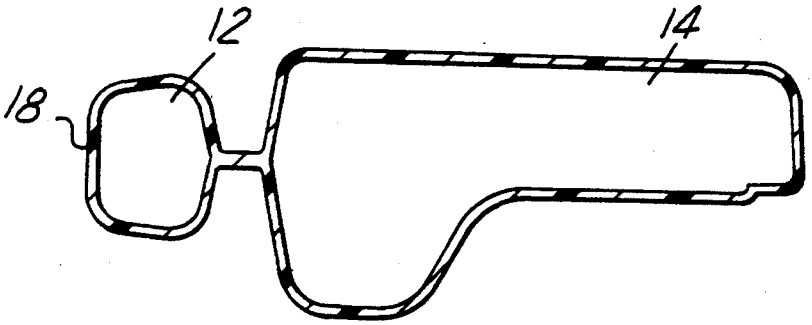
Figure 8:
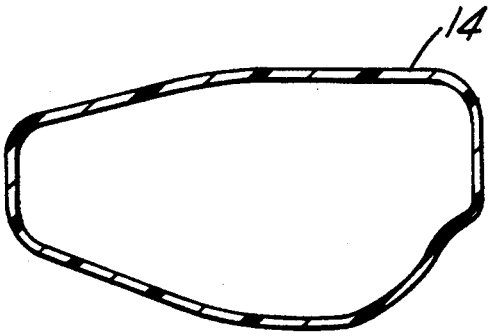
Figure 9:
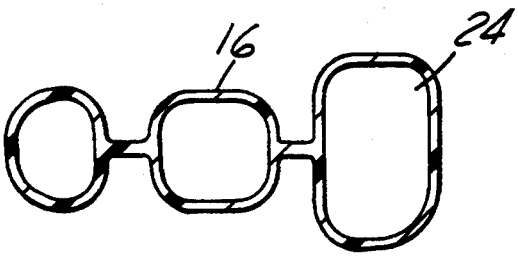

The drawings show a resonator 10 comprising an inlet pipe 12, a walled expansion chamber 14, and an outlet pipe 16. In an engine air intake system as shown in FIG. 2, inlet pipe 12 conveys fresh outside air to expansion chamber 14, and outlet pipe 16 conveys the air from expansion chamber 14 to the engine. Noise propagating from the engine passes through the system in the direction opposite that of the intake air flow.

Inlet pipe 12 comprises an upstream end 12U via which air enters resonator 12 and a downstream end 12D via which air passes into expansion chamber 14. Downstream end 12D contains a venturi 18 through which the air passes.

Outlet pipe 16 comprises an upstream end 16U via which air passes from expansion chamber 14 and a downstream end 16D via which air leaves resonator 10. Upstream end 16U contains a venturi 20 through which the air passes.

Resonator 10 imposes only minor restriction on the intake air flow, but provides a major impedance change to engine noise that propagates back through the intake system in the direction opposite the air flow. Noise entering the resonator via outlet pipe 16 first encounters venturi 20. It then encounters impedance change at the termination of outlet pipe 16 within expansion chamber 14. A further impedance change is encountered at the termination of inlet pipe 12 within expansion chamber 14, and venturi 18 imposes a final impedance change. The fact that the termination of inlet pipe 12 is not aligned with the termination of outlet pipe 16 within expansion chamber 14 also contributes to noise attenuation.

Additional noise attenuating capability is attained by also employing expansion chamber 14 as a Helmholtz resonator. This is done by means of one or more apertures 22 extending between outlet pipe 16 and an arm 24 of expansion chamber 14 that extends along side the pipe's upstream end 16U.

Resonator 10 can be fabricated by blow-mold technology as a single plastic part, or by assembling several injection-molded parts together. The particular shape that appears in the drawings has been developed to fit on a particular engine. Other shapes can be designed to accommodate other engines while retaining the inventive principles. In any design, conventional engineering calculations may be used to make the design suited for attenuating the particular noise frequencies that require attenuation.

While a presently preferred embodiment has been illustrated and described, it should be appreciated that principles are applicable to other embodiments.

What is claimed is:

1. An internal combustion engine air intake system comprising a resonator for attenuating engine noise that propagates through the system in a direction opposite intake air flow, said resonator having a walled expansion chamber, an inlet pipe for conveying intake air to said expansion chamber and an outlet pipe for conveying air from said expansion chamber, characterized in that said inlet pipe comprises an upstream end via which air enters the resonator, a downstream end via which air passes from the inlet pipe to said expansion chamber, and a venturi section through which air passes before entering said expansion chamber, and said outlet pipe comprises an upstream end having an entrance opening via which air passes from said expansion chamber into said outlet pipe, a downstream end via which air leaves the resonator, and a venturi section through which air passes after leaving said expansion chamber, characterized further in that said downstream end of said inlet pipe and said upstream end of said outlet pipe are not aligned with each other at said expansion chamber, and in that the upstream end of said outlet pipe is also communicated to said expansion chamber by aperture means that is spaced along said outlet pipe from said entrance opening to also render said expansion chamber a Helmholtz resonator for frequencies related to a dimensional characteristic of said aperture means.

2. An internal combustion engine air intake system comprising a resonator as set forth in claim 1 characterized further in that said inlet pipe, said expansion chamber, said outlet pipe, and said venturi sections form a unitary part made of plastic.

3. An internal combustion engine air intake system comprising a resonator as set forth in claim 2 characterized further in that the venturi section of said inlet pipe is disposed in the downstream end thereof and the venturi section of said outlet pipe is disposed in the upstream end thereof.

4. An internal combustion engine air intake system comprising a resonator as set forth in claim 1 characterized further in that said aperture means communicates with said outlet pipe at a location that is downstream of the venturi section of said outlet pipe.

5. An internal combustion engine air intake system comprising a resonator as set forth in claim 4 characterized further in that said expansion chamber comprises an arm that extends along side the upstream end of said outlet pipe, and said aperture means communicates with said expansion chamber via said arm.

6. An internal combustion engine air intake system comprising a resonator for attenuating engine noise that propagates through the system in a direction opposite intake air flow, said resonator having a walled expansion chamber and piping comprising an inlet pipe for conveying intake air to said expansion chamber and an outlet pipe for conveying air from said expansion chamber, said inlet pipe and said outlet pipe each having an entrance and an exit at opposite ends, characterized in that said piping comprises a venturi section through which intake air passes and in that said piping is also communicated to said expansion chamber by aperture means that is disposed between the entrance and exit of one of said pipes to also render said expansion chamber a Helmholtz resonator for frequencies related to a dimensional characteristic of said aperture means.

7. An internal combustion engine air intake system comprising a resonator as set forth in claim 6 characterized further in that said piping, said expansion chamber, said venturi section, and said aperture means form a unitary part made of plastic.

8. An internal combustion engine air intake system comprising a resonator as set forth in claim 7 characterized further in that said venturi section is in said outlet pipe and said aperture means communicates with said outlet pipe at a location of said outlet pipe that is downstream of said venturi section.

9. An internal combustion engine air intake system comprising a resonator as set forth in claim 8 characterized further in that said inlet pipe and said outlet pipe are not aligned with each other at said expansion chamber.

10. An internal combustion engine air intake system comprising a resonator as set forth in claim 9 characterized further in that said inlet pipe also includes a venturi section.

* * * * *